US008958583B2

(12) United States Patent
Hess

(10) Patent No.: US 8,958,583 B2
(45) Date of Patent: Feb. 17, 2015

(54) SPATIALLY CONSTANT SURROUND SOUND SYSTEM

(75) Inventor: Wolfgang Hess, Karlsbad (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 335 days.

(21) Appl. No.: 13/429,323

(22) Filed: Mar. 24, 2012

(65) Prior Publication Data

US 2012/0243713 A1 Sep. 27, 2012

(30) Foreign Application Priority Data

Mar. 24, 2011 (EP) ..... 11159608

(51) Int. Cl.
*H04R 5/02* (2006.01)
*H04S 7/00* (2006.01)
*H04R 5/00* (2006.01)

(52) U.S. Cl.
CPC ..... *H04S 7/302* (2013.01)
USPC ..... 381/307; 381/17; 381/26; 381/310

(58) Field of Classification Search
CPC ..... H04R 5/033; H04R 5/02; H04R 5/04
USPC ..... 381/307, 309, 310, 26, 104, 105, 107, 381/109, 74; 463/35
See application file for complete search history.

(56) References Cited

U.S. PATENT DOCUMENTS

| | | | | |
|---|---|---|---|---|
| 5,850,455 | A | 12/1998 | Arnold et al. | 381/17 |
| 8,160,282 | B2 * | 4/2012 | Christoph et al. | 381/310 |
| 2005/0078833 | A1 * | 4/2005 | Hess et al. | 381/26 |

FOREIGN PATENT DOCUMENTS

| | | | | |
|---|---|---|---|---|
| EP | 1 522 868 | A1 | 4/2005 | G01S 5/18 |
| EP | 1 843 635 | A1 | 10/2007 | H04S 7/00 |
| EP | 2 367 286 | A1 | 9/2011 | H03G 3/32 |
| WO | WO 2007/123608 | A1 | 11/2007 | H03G 3/10 |
| WO | WO 2008/085330 | A1 | 7/2008 | H03G 3/30 |

OTHER PUBLICATIONS

XP007902553, Wolfgang Hess et al., Audio engineering society convention paper 5864, Oct. 2003.*

Hess, W.; Braasch, J., Blauert, J., "Acoustical evaluation of virtual rooms by means of binaural activity patterns," Audio Engineering Society Convention Paper 5864, Oct. 2003, XP007902553, pp. 1-10; Presented at the AES 115$^{th}$ Convention, Oct. 10-13, 2003, New York, NY.

Extended European Search Report issued by the European Patent Office, in European Patent Application No. 11 159 608.6, dated Oct. 24, 2011 (9 pgs.).

(Continued)

*Primary Examiner* — Vivian Chin
*Assistant Examiner* — Ammar Hamid
(74) *Attorney, Agent, or Firm* — Brooks Kushman P.C.

(57) ABSTRACT

An audio processing system may modify an input surround sound signal to generate a spatially equilibrated output surround sound signal that is perceived by a user as spatially constant for different sound pressures of the surround sound signal. The audio processing system may determine based on a psychoacoustic model of human hearing, a loudness and a localization for a combined sound signal. The loudness and the localization may be determined by the system for a virtual user located between the front and the rear loudspeakers that has a predetermined head position in which one ear of the virtual user is directed towards one of front or rear loudspeakers and the other ear of the virtual user being directed towards the other of the front or rear loudspeakers. The audio processing system may adapt the front and/or rear audio signal channels based on the determined loudness and localization.

20 Claims, 4 Drawing Sheets

(56) References Cited

OTHER PUBLICATIONS

W. Lindemann "Extension of a Binaural Cross-Correlation Model by Contra-lateral Inhibition, I. Simulation of Lateralization for stationary signals" in Journal of Acoustic Society of America, Dec. 1986, pp. 1608-1622, vol. 80(6).

Hess, W., Time-Variant Binaural-Activity Characteristics as Indicator of Auditory Spatial Attributes, pp. 33-48, 2006, Karlsbad.

* cited by examiner

SPATIALLY CONSTANT SURROUND SOUND SYSTEM

PRIORITY CLAIM

This application claims the benefit of priority from European Patent Application No. 11 159 608.6, filed Mar. 24, 2011, which is incorporated by reference.

BACKGROUND OF THE INVENTION

1. Technical Field

The invention relates to an audio system for modifying an input surround sound signal and for generating a spatially equilibrated output surround sound signal.

2. Related Art

The human perception of loudness is a phenomenon that has been investigated and better understood in recent years. One phenomenon of human perception of loudness is a nonlinear and frequency varying behavior of the auditory system.

Furthermore, surround sound sources are known in which dedicated audio signal channels are generated for the different loudspeakers of a surround sound system. Due to the nonlinear and frequency varying behavior of the human auditory system, a surround sound signal having a first sound pressure may be perceived as spatially balanced meaning that a user has the impression that the same signal level is being received from all different directions. When the same surround sound signal is output at a lower sound pressure level, it is often detected by the listening user as a change in the perceived spatial balance of the surround sound signal. By way of example, it can be detected by the listening user that at lower signal levels the side or the rear surround sound channels are perceived with less loudness compared to a situation with higher signal levels. As a consequence, the user has the impression that the spatial balance is lost and that the sound "moves" to the front loudspeakers.

SUMMARY

An audio processing system may perform a method for modifying an input surround sound signal to generate a spatially equilibrated output surround sound signal that is perceived by a user as spatially constant for different sound pressures of the surround sound signal. The input surround sound signal may contain front audio signal channels to be output by front loudspeakers and rear audio signal channels to be output by rear loudspeakers. A first audio signal output channel may be generated based on a combination of the front audio signal channels, and a second audio signal output channel may be generated based on a combination of the rear output signal channels. Additionally, a loudness and a localisation for a combined sound signal including the first audio signal output channel and the second audio signal output channel may be determined based on a model, such as a predetermined psycho-acoustic model of human hearing.

The loudness and the localization may be determined by the audio processing system in accordance with simulation of a virtual user as being located between the front and the rear loudspeakers. The simulation may include the virtual user receiving the first audio signal output channel from the front loudspeakers and the second audio signal output channel from the rear loudspeakers. In addition, the virtual user may be simulated as having a predetermined head position in which one ear of the virtual user may be directed towards one of the front or rear loudspeakers, and the other ear of the virtual user may be directed towards the other of the front or rear loudspeakers. The simulation may be a simulation of the audio signals, listening space, loudspeakers and positioned virtual user with the predetermined head position, and/or one or more mathematical, formulaic, or estimated approximations thereof.

During operation, the front and rear audio signal channels may be adapted by the audio processing system based on the determined loudness and localization to be spatially constant. The audio processing system may adapt the front and rear audio signal channels in such a way that when the first and second audio signal output channels are output to the virtual user with the defined head position, the audio signals are perceived by the virtual user as spatially constant. Thus, the audio processing system, in accordance with the simulation, strives to adapt the front and the rear audio signals in such a way that the virtual user has the impression that the location of the received sound generated by the combined sound signal is perceived at the same location independent of the overall sound pressure level. A psycho-acoustic model of the human hearing may be used by the audio processing system as a basis for the calculation of the loudness, and may be used to simulate the localisation of the combined sound signal. One example, calculation of the loudness and the localisation based on a psycho-acoustical model of human hearing reference is described in "Acoustical Evaluation of Virtual Rooms by Means of Binaural Activity Patterns" by Wolfgang Hess et al in Audio Engineering Society Convention Paper 5864, 115th Convention of October 2003, New York. In other examples, any other form or method of determining loudness and localization based on a model, such as a psycho-acoustical model of human hearing may be used. For example, the localization of signal sources may be based on W. Lindemann "Extension of a Binaural Cross-Correlation Model by Contra-lateral Inhibition, I. Simulation of Lateralization for stationary signals" in Journal of Acoustic Society of America, December 1986, pages 1608-1622, Volume 80(6).

The perception of the localization of sound can mainly depend on a lateralization of a sound, i.e. the lateral displacement of the sound as perceived by a user. Since the audio processing system may simulate the virtual user as having a predetermined head position, the audio processing system may analyze the simulation of movement of a head of the virtual user to confirm that the virtual user receives the combined front audio signal channels with one ear and the combined rear audio signal channels with the other ear. If the perceived sound by the virtual user is located in the middle between the front and the rear loudspeakers, a desirable spatial balance may be achieved. If the perceived sound by the user, such as when the sound signal level changes, is not located in the middle between the rear and front loudspeakers, the audio signal channels of the front and/or rear loudspeakers may be adapted by the audio processing system such that the audio signal as perceived is again located by the virtual user in the middle between the front and rear loudspeakers.

One possibility to locate the virtual user is to locate the user facing the front loudspeakers and turning the head of the virtual user by about 90° from a first position to a second position so that one ear of the virtual user receives the first audio signal output channel from the front loudspeakers and the other ear receives the second audio signal output channel from the rear loudspeakers. A lateralization of the received audio signal is then determined taking into account a difference in reception of the received sound signal for the two ears as the head of the virtual user is turned. The front and/or rear audio signal surround sound channels are then adapted in such a way that the lateralization remains substantially constant and remains in the middle for different sound pressures of the input surround sound signal.

Furthermore, it is possible to apply a binaural room impulse response (BRIR) to each of the front and rear audio signal channels before the first and second audio output channels are generated. The binaural room impulse response for each of the front and rear audio signal channels may be determined for the virtual user having the predetermined head position and receiving audio signals from a corresponding loudspeaker. By taking into account the binaural room impulse response a robust differentiation between the audio signals from the front and rear loudspeakers is possible for the virtual user. The binaural room impulse response may further be used to simulate the virtual user with the defined head position having the head rotated in such a way that one ear faces the front loudspeakers and the other ear faces the rear loudspeakers.

Furthermore, the binaural room impulse response may be applied to each of the front and the rear audio signal channels before the first and the second audio signal output channels are generated. The binaural room impulse response that is used for the signal processing, may be determined for the virtual user having the defined head position and receiving audio signals from a corresponding loudspeaker. As a consequence, for each loudspeaker two BRIRs may be determined, one for the left ear and one for the right ear of the virtual user having the defined head position.

Additionally, it is possible to divide the surround sound signal into different frequency bands and to determine the loudness and the localization for different frequency bands. An average loudness and an average localization may then be determined based on the loudness and the localization of each of the different frequency bands. The front and the rear audio signal channels can then be adapted based on the determined average loudness and average localization. However, it is also possible to determine the loudness and the localization for the complete audio signal without dividing the audio signal into different frequency bands.

To further improve the simulation of the virtual user, an average binaural room impulse response may be determined using a first and a second binaural room impulse response. The first binaural room impulse response may be determined for the predetermined head position of the virtual user, and the second binaural room impulse response may be determined for the opposite head position with the head of the virtual user being turned about 180° from the predetermined head position. The binaural room impulse response for the two head positions can then be averaged to determine the average binaural room impulse response for each surround sound signal channel. The determined average BRIRs can then be applied to the front and rear audio signal channels before the front and rear audio signal channels are combined to form the first and second audio signal output channels.

For adapting the front and the rear audio signal channels, a gain of the front and/or rear audio signal channel may be adapted in such a way that a lateralization of the combined sound signal is substantially constant even for different sound signal levels of the surround sound.

The audio processing system may correct the input surround sound signal to generate the spatially equilibrated output surround sound signal. The audio processing system may include an audio signal combiner unit configured to generate the first audio signal output channel based on the front audio signal channels and configured to generate the second audio signal output channel based on the rear audio signal channels. An audio signal processing unit is provided that may be configured to determine the loudness and the localization for a combined sound signal including the first and second audio signal channels based on a psycho-acoustic model of human hearing. The audio signal processing system may use the virtual user with the defined head position to determine the loudness and the localization. A gain adaptation unit may adapt the gain of the front or rear audio signal channels or the front and the rear audio signal channels based on the determined loudness and localization so that the audio signals perceived by the virtual user are received as spatially constant.

The audio signal processing unit may determine the loudness and localization and the audio signal combiner may combine the front audio signal channels and the rear audio signal channels and apply the binaural room impulse responses as previously discussed.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention will be described in further detail with reference to the accompanying drawings, in which.

DETAILED DESCRIPTION OF THE PREFERRED EMBODIMENTS

Figure 1:
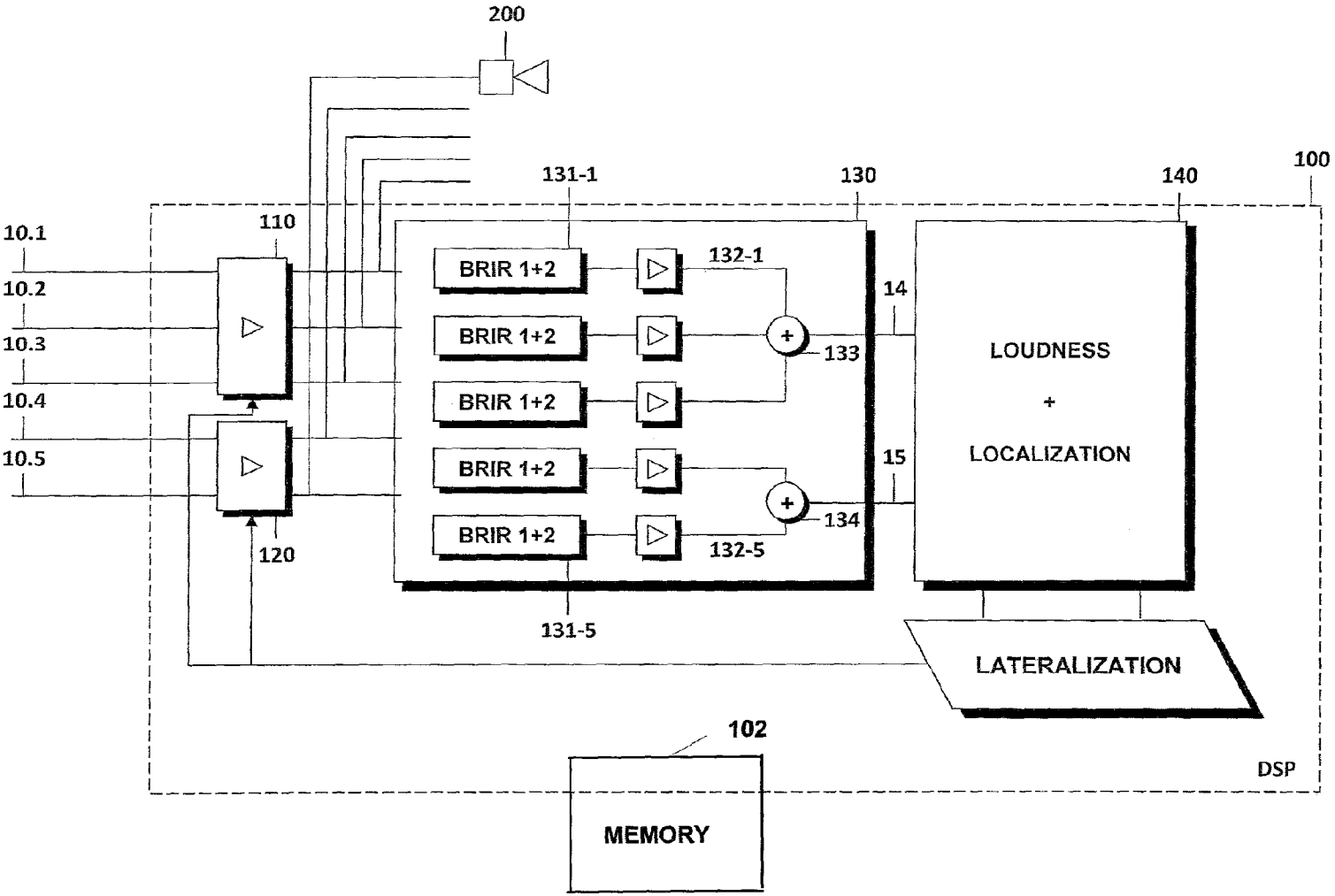
FIG. 1 is a schematic view of an example audio processing system for adapting a gain of a surround sound signal.

FIG. 1 shows an example schematic view allowing a multi-channel audio signal to be output at different overall sound pressure levels by an audio processing system while maintaining a constant spatial balance. The audio processing system may be included as part of an audio system an audio/visual system, or any other system or device that processes multiple audio channels. In one example, the audio processing system may be included in an entertainment system such as a vehicle entertainment system, a home entertainment system, or a venue entertainment system, such as a dance club, a theater, a church, an amusement park, a stadium, or any other public venue where audio signals are used to drive loudspeakers to output audible sound.

In the example shown in FIG. 1 the audio sound signal is a surround sound signal, such as a 5.1 sound signal, however, it can also be a 7.1 sound signal, a 6.1 channel sound signal, or any other multi-channel surround sound audio input signal. The different channels of the audio sound signal 10.1 to 10.5 are transmitted to an audio processing system that includes a processor, such as a digital signal processor or DSP 100 and a memory 102. The sound signal includes different audio signal channels which may be dedicated to the different loudspeakers 200 of a surround sound system. Alternatively, or in addition, the different audio signals may be shared among multiple loudspeakers, such as where multiple loudspeakers are cooperatively driven by a right front audio channel signal.

Figure 3:
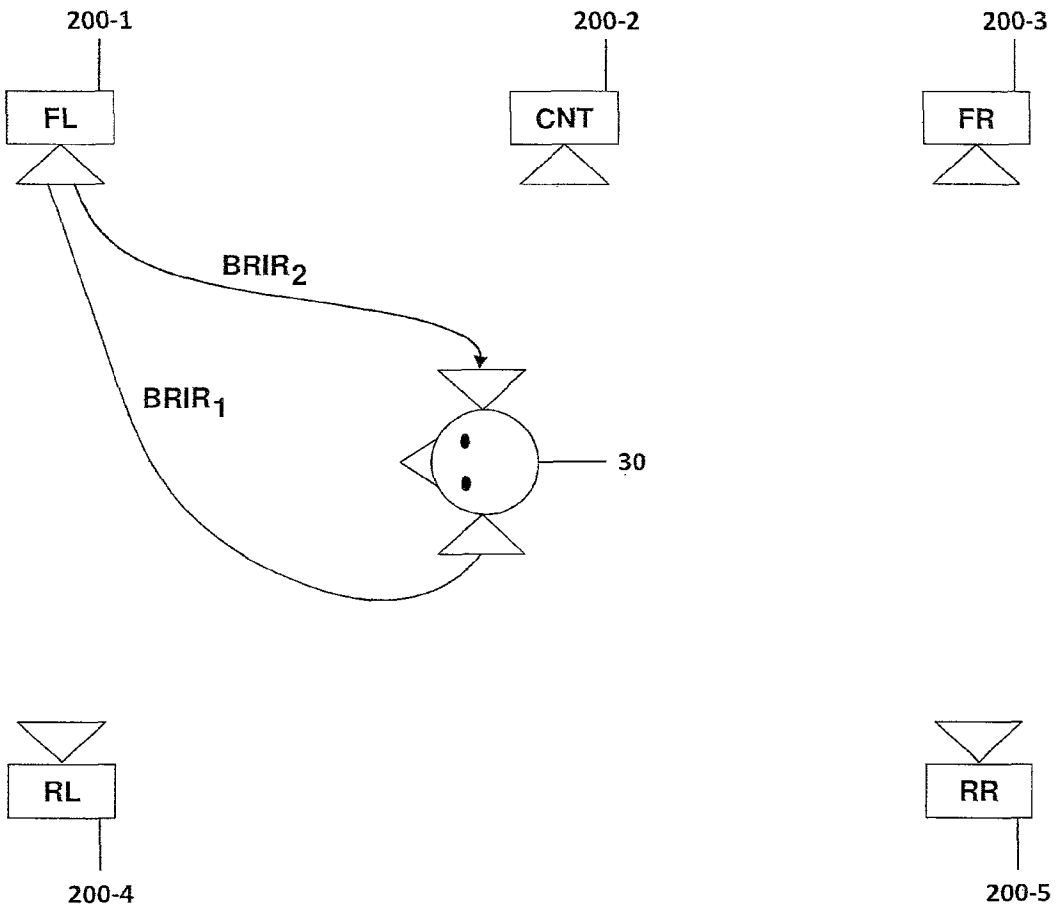
FIG. 3 is a schematic view illustrating determination of different binaural room impulse responses.

In the illustrated example only one loudspeaker, via which the sound signal is output, is shown. However, it should be understood that for each surround sound input signal channel 10.1 to 10.5 at least one loudspeaker is provided through which the corresponding signal channel of the surround sound signal is output as audible sound. As used herein, the terms "channel" or "signal" are used to interchangeably describe an audio signal in electro magnetic form, and in the form of audible sound. In the example 5.1 audio system three audio channels, shown as the channels 10.1 to 10.3 are directed to front loudspeakers (FL, CNT and FR) as shown in FIG. 3. One of the surround sound signals is output by a front-left loudspeaker 200-1, the other front audio signal channel is output by the center loudspeaker 200-2 and the third front audio signal channel is output by the front loudspeaker on the right 200-3. The two rear audio signal channels 10.4 and 10.5 are output by the left rear loudspeaker 200-4 and the right rear loudspeaker 200-5.

In FIG. 1, the surround sound signal channels may be transmitted to gain adaptation units 110 and 120 which can adapt the gain of the respective front and rear surround sound signals in order to obtain a spatially constant and centered audio signal perception, as further discussed later. Although illustrated as a front gain adaptation unit 110 and a rear gain adaptation unit 120, in some examples the gain of each channel may be independently adapted. An audio signal combiner unit 130 is also provided. In the audio signal combiner 130, direction information for a virtual user may be superimposed on the audio signal channels. In the audio signal combiner 130 the binaural room impulses responses determined for each signal channel and the corresponding loudspeaker may also be applied to the corresponding audio signal channels of the surround sound signal. The audio signal combiner unit 130 may output a first audio signal output channel 14 and a second audio signal output channel 15 representing a combination of the front audio signal channels and the rear audio signal channels, respectively.

In connection with FIG. 3 an example situation is shown within which a virtual user 30 having a defined head position receives audio signals from the different loudspeakers. For each of the loudspeakers shown in FIG. 3 a signal is emitted in a room, or other listening space, such as a vehicle, a theater or elsewhere in which the audio processing system could be applied, and the binaural room impulse response may be determined for each surround sound signal channel and for each corresponding loudspeaker. By way of example, for the front audio signal channel dedicated for the front left loudspeaker, the left front signal is propagating through the room and is detected by the two ears of virtual user 30. The detected impulse response for an impulse audio signal represented by the left front audio signal is the binaural room impulse response (BRIR) for each of the left ear and for the right ear so that two BRIRs are determined for the left audio signal channel (here BRIR1+2). Additionally, the BRIR1+2's for the other audio channels and corresponding loudspeakers 200-2 to 200-5 may be determined using the virtual user 30 having a head with a head position as shown in which one ear of the virtual user faces the front loudspeakers, and the other ear of the virtual user faces the rear loudspeakers. These BRIRs for each audio signal channel and the corresponding loudspeaker may be determined by binaural testing, such as using a dummy head with microphones positioned in the ears. The determined BRIRs can then be stored in the memory 102, and accessed by the signal combiner 130 and applied to the audio signal channels.

In the example of FIG. 1 two BRIRs for each audio signal channel may be applied to the corresponding audio signal channel as received from the gain adaptation units 110 and 120. In the example shown, as the audio signal has five surround sound signal channels, five pairs of BRIRs are used in the corresponding impulse response units 131-1 to 131-5. Furthermore, an average BRIR may be determined by measuring the BRIR for the head position shown in FIG. 3 (90° head rotation) and by measuring the BRIR for the virtual user facing in the opposite direction (270°). When the virtual user 30 is facing the left and right front loudspeakers (FL and FR) 200-1 and 200-3, and the center loudspeaker (CNT) 200-2 a nose of the virtual user 30 is generally pointing in a direction toward the left and right front loudspeakers (FL and FR) 200-1 and 200-3, and the center loudspeaker (CNT) 200-2. When the head of the virtual user is positioned as illustrated in FIG. 3 at a 90° head rotation, a first ear of the user is generally facing toward, or directed toward the front loudspeakers 200-1-200-3, and a second ear of the virtual user is facing toward or directed toward the rear loudspeakers 200-4-200-5. Conversely, when the head position of the virtual user is at a head rotation of 270° the second ear of the user is generally facing toward, or directed toward the front loudspeakers 200-1-200-3, and a first ear of the virtual user is facing toward or directed toward the rear loudspeakers 200-4-200-5. Based on the BRIRs for the head of the virtual user facing 90° and 270° an average BRIR can be determined for each ear.

By applying the BRIRs obtained with a situation as shown in FIG. 3 a situation can be simulated with the audio processing system as if the virtual user had turned the head to one side, such as rotation from a first position to a second position, which is illustrated in FIG. 3 as the 90° rotation. Accordingly, the first position of the virtual user may be facing the front loudspeakers, and the second position may be the rotation 90° position illustrated In FIG. 3. After applying the BRIRs in units 131-1 to 131-5 the different surround sound signal channels may be adapted by a gain adaptation unit 132-1, 132-5 for each surround sound signal channel. The sound signals to which the BRIRs have been applied may then be combined in such a way that the front channel audio signals are combined to generate a first audio signal output channel 14 by adding them in a front adder unit 133. The surround sound signal channels for the rear loudspeakers are then added in a rear adder unit 134 to generate a second audio signal output channel 15.

The first audio signal output channel 14 and the second audio signal output channel 15 may each be used to build a combined sound signal that is used by an audio signal processing unit 140 to determine a loudness and a localization of the combined audio signal based on a predetermined psychoacoustical model of the human hearing stored in the memory 102. An example process for determine the loudness and the localization of a combined audio signal from an audio signal combiner is described in W. Hess: "Time Variant Binaural Activity Characteristics as Indicator of Auditory Spatial Attributes". In other examples, other types of processing of the first audio signal output channel 14 and the second audio signal output channel 15 may be used by the audio signal processing unit 140 to determine a loudness and a localization of the combined audio signal.

The audio signal processor 140 may be configured to perform, oversee, participate in, and/or control the functionality of the audio processing system described herein. The audio signal processor 140 may be configured as a digital signal processor (DSP) performing at least some of the described functionality. Alternatively, or in addition, the audio signal processor 140 may be or may include a general processor, an application specific integrated circuit (ASIC), a field programmable gate array (FPGA), an analog circuit, a digital circuit, or any other now known or later developed processor. The audio signal processor 140 may be configured as a single device or combination of devices, such as associated with a network or distributed processing. Any of various processing strategies may be used, such as multi-processing, multi-tasking, parallel processing, remote processing, centralized processing or the like.

The audio signal processor 140 may be responsive to or operable to execute instructions stored as part of software, hardware, integrated circuits, firmware, micro-code, or the like. The audio signal processor 140 may operate in association with the memory 102 to execute instructions stored in the memory. The memory may be any form of one or more data storage devices, such as volatile memory, non-volatile memory, electronic memory, magnetic memory, optical memory, or any other form of device or system capable of storing data and/or instructions. The memory 102 may be on board memory included within the audio signal processor 140, memory external to the audio signal processor 140, or a combination.

The units shown in FIG. 1 may be incorporated by hardware or software or a combination of hardware and software. The term "unit" may be defined to include one or more executable units. As described herein, the units are defined to include software, hardware or some combination thereof executable by the audio signal processor 140. Software units may include instructions stored in the memory 102, or any other memory device, that are executable by the audio signal processor 140 or any other processor. Hardware units may include various devices, components, circuits, gates, circuit boards, and the like that are executable, directed, and/or controlled for performance by the audio signal processor 140.

Figure 2:
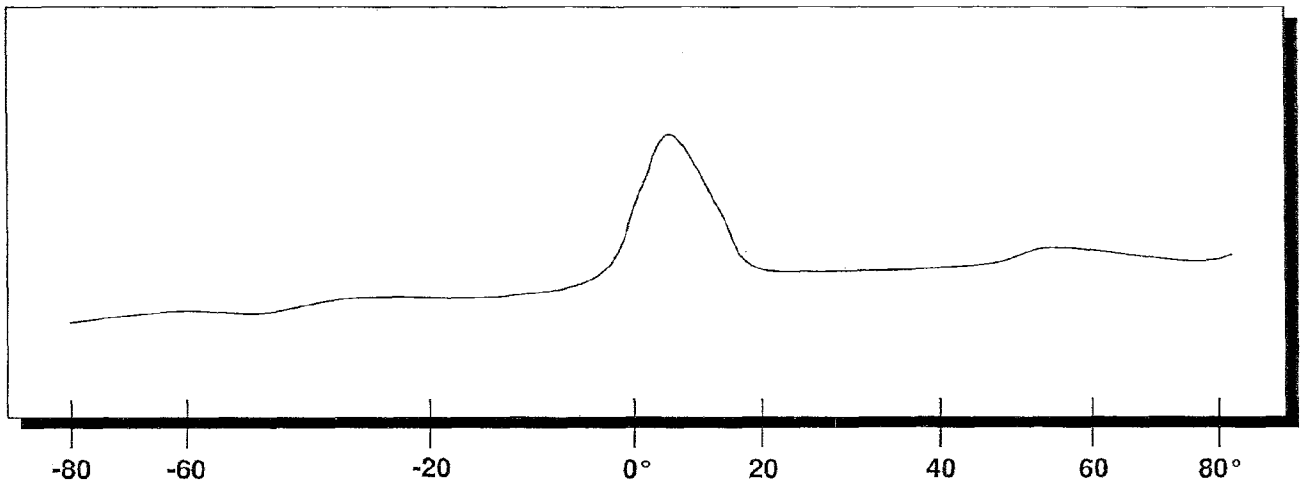
FIG. 2 schematically shows an example of a determined lateralization of a combined sound signal.

Based on the loudness and localization determined by the audio signal processor 140, it is possible for the lateralization unit to deduce a lateralization of the sound signal as perceived by the virtual user in the position shown in FIG. 3. An example of such a calculated lateralization is shown in FIG. 2. It shows whether the signal peak is perceived by the user in the middle (0°) (where the user's nose is pointing) or whether it is perceived as originating more from the right or left side (toward 80° or −80°, respectively, for example). Applied to the virtual user shown in FIG. 3 (the head turned 90°) this would mean that if the sound signal is perceived as originating more from the right side, the front loudspeakers 200-1 to 200-3 may seem to output a higher sound signal level than the rear loudspeakers. If the signal is perceived as originating from the left side, the rear loudspeakers 200-4 and 200-5 may seem to output a higher sound signal level compared to the front loudspeakers. If the signal peak is located at approximately 0°, the surround sound signal may be spatially equilibrated such that the front loudspeakers 200-1 to 200-3 may seem to output a substantially similar sound signal level to that of the rear loudspeakers 200-4 and 200-5.

The lateralization determined by the audio signal processing unit 140 may be provided to gain adaptation unit 110 and/or to gain adaptation unit 120. The gain of the input surround sound signal may then be adapted in such a way that the lateralization is moved to substantially the middle (0°) as shown in FIG. 2. To this end, either the gain of the front audio signal channels or the gain of the rear audio signal channels may be adapted (increased or decreased to increase or attenuate the signal level of the corresponding audio signals). In another example the gain in either the front audio signal channels or the rear audio signal channels may be increased whereas it is decreased in the other of the front and rear audio signal channels. The gain adaptation may be carried out such that the audio signal, such as a digital audio signal, which is divided into consecutive blocks or samples, is adapted in such a way that the gain of each block may be adapted to either increase the signal level or to decrease the signal level. An example to increase or decrease the signal level using raising time constants or falling time constants describing a falling loudness or an increasing loudness of the signals between two consecutive blocks is described in the European patent application number EP 10 156 409.4.

For the audio processing shown in FIG. 1 the surround sound input signal may be divided into different spectral components or frequency bands. The processing steps shown in FIG. 1 can be carried out for each spectral band and at the end an average lateralization can be determined by the lateralization unit based on the lateralization determined for the different frequency bands.

When an input surround signal is received with a varying signal pressure level, the gain can be dynamically adapted by the gain adaptation units 110 or 120 in such a way that an equilibrated spatiality is obtained, meaning that the lateralization will stay constant in the middle at about (0°) as shown in FIG. 2. Thus, independence of the received signal pressure level leads to a constant perceived spatial balance of the audio signal.

Figure 4:
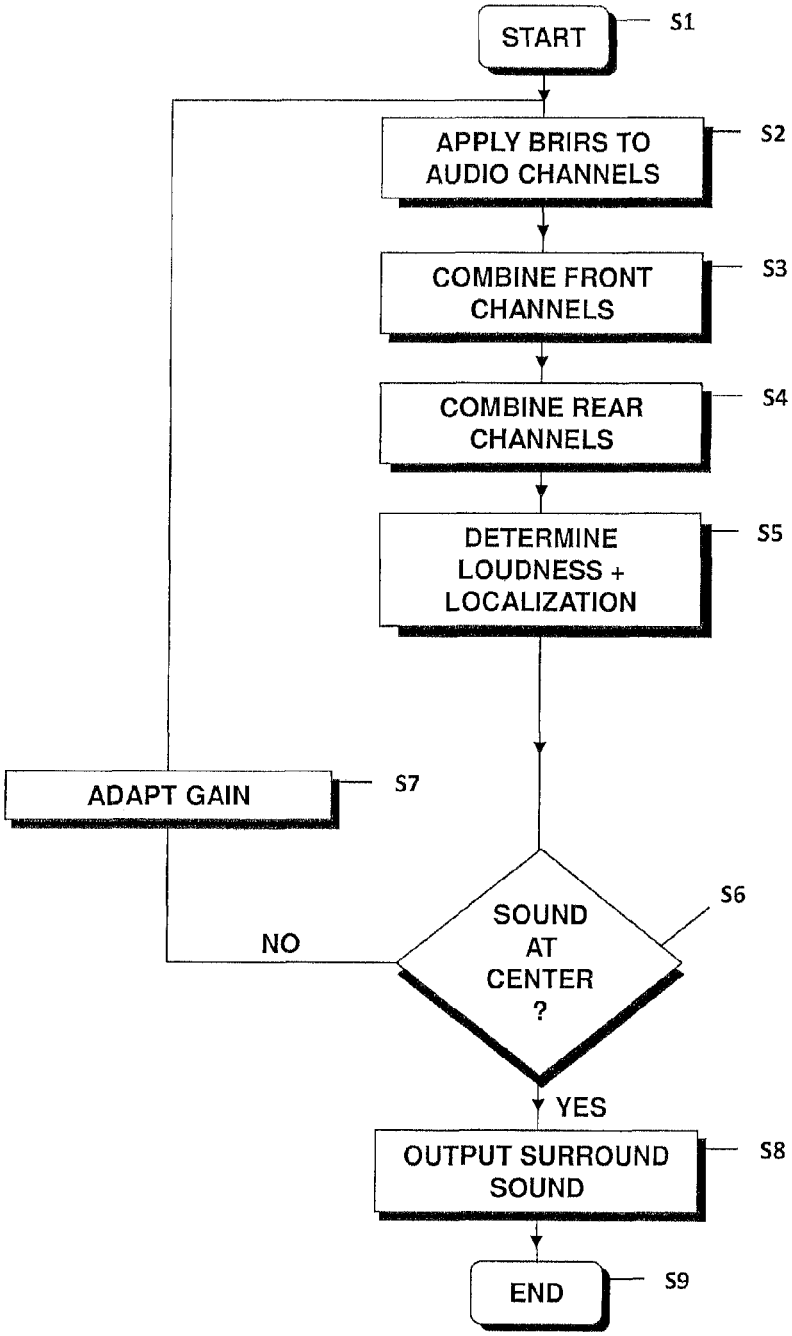
FIG. 4 is a flow-chart illustrating example operation of the audio signal processing system to output a spatially equilibrated sound signal.

An example operation carried out for obtaining this spatially balanced audio signal is illustrated in FIG. 4. The method starts in step S1 and in step S2 the determined binaural room impulse responses are applied to the corresponding surround sound signal channels. In step S3, after the application of the BRIRs, the front audio signal channels are combined to generate the first audio signal channel 14 using adder unit 133. In step S4 the rear audio signal channels are combined to generate the second audio signal channel 15 using adder unit 134. Based on signals 14 and 15, the loudness and the localization is determined in step S5. In step S6 it is then determined whether the sound is perceived at the center or not. If this is not the case, the gain of the surround sound signal input channels is adapted in step S7 and steps S2 to S5 are repeated. If it is determined in step S6 that the sound is at the center, the sound is output in step S8, the method ending in step S9.

In the following an example of the calculation of the loudness and the localization based on a psychoacoustic model of human hearing is explained in more detail. The psychoacoustic model of the human hearing may use a physiological model of the human ear and simulate the signal processing for a sound signal emitted from a sound source and detected by a human. In this context the signal path of the sound signal through the room, the outer ear and the inner ear is simulated. The signal path can be simulated using a signal processing device. In this context it is possible to use two microphones arranged spatially apart resulting in two audio channels which are processed by the physiological model. When the two microphones are positioned in the right and left ear of a dummy head with the replication of the external ear, the simulation of the external ear can be omitted as the signal received by the microphone can pass through the external ear of the dummy head. In this context it is sufficient to simulate an auditory pathway just accurately enough to be able to predict a number of psychoacoustic phenomena which are of interest, e.g. a binaural activity pattern (BAP), an inter-aural time difference (ITD), and an inter-aural level difference (ILD). Based on the above values a binaural activity pattern can be calculated. The pattern can then be used to determine a position information, time delay, and a sound level.

The loudness can be determined based on the calculated signal level, energy level, or intensity. For an example of how the loudness can be calculated and how the signal can be localized using the psychoacoustic model of human hearing, reference is also made to EP 1 522 868 A1. The position of the sound source in a listener perceived sound stage may be determined by any mechanism or system. In one example, EP 1 522 868 A1 describes that the position information may be determined from a binaural activity pattern (BAP), the interaural time differences (ITD), and the interaural level differences (ILD) present in the audio signal detected by the microphones. The BAP may be represented with a time-dependent intensity of the sound signal in dependence on a lateral deviation of the sound source. In this example, the relative position of the sound source may be estimated by transformation from an ITD-scale to a scale representing the position on a left-right deviation scale in order to determine lateral deviation. The determination of BAP may be used to determine a time delay, a determination of an intensity of the sound signal, and a determination of the sound level. The time delay can be determined from time dependent analysis of the intensity of the sound signal. The lateral deviation can be determined from an intensity of the sound signal in dependence on a lateral position of the sound signal relative to a reference position. The sound level can be determined from a maximum value or magnitude of the sound signal. Thus, the parameters of lateral position, sound level, and delay time may be used to determine the relative arrangement of the sound sources. In this example, the positions and sound levels may be calculated in accordance with a predetermined standard configuration, such as the ITU-R BS.775-1 standard using these three parameters.

The previously discussed audio system allows for generation of a spatially equilibrated sound signal that is perceived by the user as spatially constant even if the signal pressure level changes. As previously discussed, the audio processing system includes a method for dynamically adapting an input surround sound signal to generate a spatially equilibrated output surround sound signal that is perceived by a user as spatially constant for different sound pressures of the surround sound signal. The input surround sound signal may contain front audio signal channels (10.1-10.3) to be output by front loudspeakers (200-1 to 200-3) and rear audio signal channels (10.4, 10.5) to be output by rear loudspeakers. The audio signals may be dynamically adapted on a sample by sample basis by the audio processing system.

An example method includes the steps of generating a first audio signal output channel (14) based on a combination of the front audio signal channels, generating a second audio signal output channel (15) based on a combination of the rear audio signal channels. The method further includes determining, based on a psychoacoustic model of human hearing, a loudness and a localisation for a combined sound signal including the first audio signal output channel (14) and the second audio signal output channel (15), wherein the loudness and the localisation is determined for a virtual user (30) located between the front and the rear loudspeakers (200). The virtual user receives the first signal (14) from the front loudspeakers (200-1 to 200-3) and the second audio signal (15) from the rear loudspeakers (200-4, 200-5) with a defined head position of the virtual user in which one ear of the virtual user is directed towards one of the front or rear loudspeakers the other ear being directed towards the other of the front or rear loudspeakers. The method also includes adapting the front and/or rear audio signal channels (10.1-10.5) based on the determined loudness and localisation in such a way that, when first and second audio signal output channels are output to the virtual user with the defined head position, the audio signals are perceived by the virtual user as spatially constant.

In the previously described examples, one or more processes, sub-processes, or process steps may be performed by hardware and/or software. Additionally, the audio processing system, as previously described, may be implemented in a combination of hardware and software that could be executed with one or more processors or a number of processors in a networked environment. Examples of a processor include but are not limited to microprocessor, general purpose processor, combination of processors, digital signal processor (DSP), any logic or decision processing unit regardless of method of operation, instructions execution/system/apparatus/device and/or ASIC. If the process or a portion of the process is performed by software, the software may reside in the memory 102 and/or in any device used to execute the software. The software may include an ordered listing of executable instructions for implementing logical functions, i.e., "logic" that may be implemented either in digital form such as digital circuitry or source code or optical circuitry or in analog form such as analog circuitry, and may selectively be embodied in any machine-readable and/or computer-readable medium for use by or in connection with an instruction execution system, apparatus, or device, such as a computer-based system, processor-containing system, or other system that may selectively fetch the instructions from the instruction execution system, apparatus, or device and execute the instructions. In the context of this document, a "machine-readable medium," or "computer-readable medium," is any means that may contain, store, and/or provide the program for use by the audio processing system. The memory may selectively be, for example but not limited to, an electronic, magnetic, optical, electromagnetic, infrared, or semiconductor system, apparatus, or device. More specific examples, but nonetheless a non-exhaustive list, of computer-readable media includes: a portable computer diskette (magnetic); a random access memory (RAM); a read-only memory (ROM); an erasable programmable read-only memory (EPROM or Flash memory); an optical memory; and/or a portable compact disc read-only memory "CDROM" "DVD".

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A method for modifying an input surround sound signal to generate a spatially equilibrated output surround sound signal that is perceived by a user as spatially constant for different sound pressures of the output surround sound signal, the input surround sound signal containing front audio signal channels to be output by front loudspeakers and rear audio signal channels to be output by rear loudspeakers, the method comprising the steps of:

generating a first audio signal output channel with an audio processing system based on a combination of the front audio signal channels, generating a second audio signal output channel with the audio processing system based on a combination of the rear audio channels;

determining with the audio processing system, based on a psychoacoustic model of human hearing, a loudness and a localisation for a combined sound signal including the first audio signal output channel and the second audio signal output channel, where the loudness and the localisation is determined by the audio processing system for a virtual user simulated by the audio processing system as located between the front and the rear loudspeakers and receiving the first audio signal channel from the front loudspeakers and the second audio signal channel from the rear loudspeakers with a predetermined head position of a head of the virtual user simulated by the audio processing system with one ear of the virtual user being directed towards the front loudspeakers and another ear of the virtual user being directed towards the rear loudspeakers; and adapting the front and rear audio signal channels of the input surround sound signal with the audio processing system based on the determined loudness and localisation so that the first and second audio signal output channels simulated as being output to the virtual user with the predetermined head position are perceived by the virtual user as spatially constant.

2. The method according to claim 1, where determining with the audio processing system, based on the psychoacoustic model of human hearing, the loudness and the localisation further comprises the steps of:

the audio processing system simulating a situation where the virtual user is facing the front loudspeakers and further simulating the virtual user as turning the head of the virtual user by about 90 degrees to the predetermined head position; and determining a lateralisation of the received audio signal with the audio processing system based on the turning of the head by taking into account a difference in simulated reception of the received audio signal for the ear and the other ear during the situation.

3. The method according to claim 2, where adapting the front and rear audio signal channels further comprises the step of the audio processing system adapting at least one of the front audio signal channels or the rear audio signal channels so that the lateralisation remains substantially constant for different sound pressures of the input surround sound signal.

4. The method according to claim 1, further comprising the step of applying a binaural room impulse response to each of the front and rear audio signal output channels with the audio processing system before the first and the second audio signal channels are generated, the binaural room impulse response for each of the front and rear audio signal channels being determined for the virtual user having the predetermined head position and receiving audio signals from a corresponding loudspeaker.

5. The method according to claim 1, where determining with the audio processing system, based on the psychoacoustic model of human hearing, the loudness and the localisation further comprises the steps of:

determining a loudness and a localization for each of a plurality of different frequency bands of the input surround sound signal; and determining an average loudness and an average localisation with the audio signal processing system based on the loudness and the localisation of each of the different frequency bands.

6. The method according to claim 5, where adapting the front and rear audio signal channels comprises adapting the front and the rear audio signal channels of the surround sound signal based on the determined average loudness and the determined average localisation.

7. The method according to claim 1, further comprising the steps of:

providing a first binaural room impulse response determined for the predetermined head position;

providing a second binaural room impulse response determined for a further predetermined head position in which the head of the virtual user is turned by 180° compared to the predetermined head position;

providing an average binaural room impulse response determined based on the first binaural room impulse response and the second binaural room impulse response; and applying the average binaural room impulse response to the front and rear audio signal channels with the audio signal processing system.

8. The method according to claim 1, further comprising the steps of:

providing a corresponding binaural impulse response determined for each of the respective front and rear audio signal channels and a corresponding loudspeaker;

generating the first audio signal output channel with the audio processing system by combining the front audio signal channels, after the corresponding binaural room impulse response has been applied to each respective front audio signal channel; and generating the second audio signal output channel with the audio signal processing system by combining the rear audio signal channels, after the corresponding binaural room impulse response has been applied to each respective rear audio signal channel.

9. The method according to claim 1, further comprising the step of adjusting at least one of a gain of the front audio signal channels or a gain of the rear audio signal channels with the audio signal processing system so that a lateralisation of the combined sound signal is substantially constant.

10. A system for modifying an input surround sound signal to generate a spatially equilibrated output surround sound signal that is perceived by a user as spatially constant for different sound pressures of the surround sound signal, the input surround sound signal containing front audio signal channels to be output by front loudspeakers and rear audio signal channels to be output by rear loudspeakers, the system comprising:

an audio signal combiner configured to generate a first audio signal output channel based on a combination of the front audio signal channels, and configured to generate a second audio signal output channel based on a combination of the rear audio signal channels;

an audio signal processing unit configured to determine, based on a psychoacoustic model of human hearing, a loudness and a localisation for a combined sound signal including the first audio signal output channel and the second audio signal output channel, the audio signal processing unit configured to determine the loudness and localisation based on simulation of a virtual user as located between the front and the rear loudspeakers and in receipt of the first audio signal output channel from the front loudspeakers and the second audio signal output channel from the rear loudspeakers, a head of the virtual user simulated by an audio processing system to have a predetermined head position in which one ear of the virtual user is directed towards the front loudspeakers and another ear of the virtual user being directed towards the rear loudspeakers; and a gain adaptation unit configured to adapt a gain of the front and rear audio signal channels based on the determined loudness and localisation so that simulated output of the first and second audio signal channels to the virtual user having the predetermined head position are perceived by the virtual user as spatially constant.

11. The system according to claim 10, where the audio signal processing unit is further configured to determine the loudness and the localisation by simulation of a situation where the virtual user is facing the front loudspeakers and the head of the virtual user is turned by about 90 degrees to the predetermined head position; and where the audio signal processing unit is further configured to determine a lateralisation of the received audio signal as a function of a difference in reception of the received sound signal for the one ear and the other ear during the simulation of the situation.

12. The system according to claim 11, where the gain adaptation unit is configured to adapt at least one of the front or the rear audio signal channels so that the lateralisation remains substantially constant for different sound pressures of the input surround sound signal.

13. The system according to claim 10, where the audio signal combiner is further configured to apply a binaural room impulse response to each of the front and rear audio signal channels prior to generation of the first and the second audio signal output channels, the binaural room impulse response for each of the front and rear audio signal channels determined for the virtual user having the predetermined head position based on receipt of a respective one of the front or the rear audio signal channels from a corresponding loudspeaker.

14. The system according to claim 10, where the audio signal combiner is configured to retrieve a stored a corresponding binaural room impulse response determined for each loudspeaker using the virtual user having the predetermined head position, and the audio signal combiner is further configured to combine the front audio signal channels to generate the first audio signal output channel after application of the corresponding binaural room impulse response for each corresponding loudspeaker to each respective front audio signal channel, and combine the rear audio signal channels to generate the second audio signal output channel after application of the corresponding binaural room impulse response for each corresponding loudspeaker to each respective rear audio signal channel.

15. The system of claim 10, where the audio signal processing unit is further configured to divide the surround sound signal into a plurality of frequency bands and determine the loudness and the localisation for each of the frequency bands, and where the audio signal processing unit is further configured to determine an average loudness and an average localisation based on the loudness and localisation of each of the frequency bands, the gain adaptation unit configured to adapt the front and rear audio signal channels based on the determined average loudness and the determined average localisation.

16. The system of claim 10, where the audio signal combiner is configured to use an average binaural impulse response determined based on a first and a second binaural impulse response, the first binaural impulse response being determined for the predetermined head position, and the second binaural impulse response being determined for a further predetermined head position in which the head of the virtual user is turned by 180.degree. compared to the predetermined head position, wherein the audio signal processing unit is further configured to apply, for each of the front and rear audio signal channels, the corresponding average binaural impulse response to the corresponding front and rear audio signal channels before the front audio signal channels are combined to form the first audio signal output channel, and the rear audio signal channels are combined to form the second audio signal output channel.

17. A non-transitory tangible computer readable storage medium configured to store a plurality of instructions executable by a processor, the computer readable storage medium comprising:

instructions to receive an input surround sound signal, the input surround sound signal including a plurality of front audio signal channels configured drive front loudspeakers and a plurality of rear audio signal channels configured to drive rear loudspeakers;

instructions to combine the front audio signal channels to form a first audio signal output channel, and combine the rear audio signal channels to form a second audio signal output channel;

instructions to determine a loudness and a localization of the first audio signal output channel and the second audio signal output channel based on a psychoacoustic model of human hearing stored in the tangible computer readable storage medium and a virtual user;

the virtual user comprising instructions to simulate receipt from respective loudspeakers of front audio signal channels and rear audio signal channels by the virtual user positioned between the front loudspeakers and the rear loudspeakers so that a first ear of the virtual user is directed towards the front loudspeakers and a second ear of the virtual user is directed towards the rear loudspeakers;

instructions to dynamically adjust a gain of at least one of the front audio signal channels or the rear audio signal channels based on the determined loudness and localization to generate a spatially equilibrated output surround sound signal that is perceptually spatially constant for different sound pressures of the output surround sound signal.

18. The non-transitory tangible computer readable medium of claim 17, where the virtual user further comprises instructions to simulate a rotation of a head location of the virtual user by about 90 degrees between a first position and a second position; and instructions to adapt at least one of the front audio signal channels or the rear audio signal channels to maintain lateralisation as substantially constant for different sound pressures of the input surround sound signal based on the simulated rotation.

19. The non-transitory tangible computer readable medium of claim 18, where the instructions to dynamically adjust a gain comprises instructions to determine a lateralization of the front audio signal channels and rear audio signal channels received by the virtual user, and instructions to use changes in lateralization away from equality as a basis for dynamic adjustment of the gain.

20. The non-transitory tangible computer readable medium of claim 18, further comprising instructions to apply a binaural room impulse response to each of the front and rear audio signal channels prior to formation of the first and the second audio signal output channels, the binaural room impulse response for each of the front and rear audio signal channels determined for the virtual user based on receipt of one of the front or the rear audio signal channels from a corresponding loudspeaker.

* * * * *